United States Patent [19]

Savioli

[11] Patent Number: 4,587,879

[45] Date of Patent: May 13, 1986

[54] WEAPON CARTRIDGE FEEDER APPARATUS AND METHOD

[75] Inventor: Giulio V. Savioli, Andover, N.J.

[73] Assignee: The United States of America as represented by the Secretary of the Army, Washington, D.C.

[21] Appl. No.: 553,204

[22] Filed: Nov. 18, 1983

[51] Int. Cl.[4] ..... F41D 10/06; F41D 10/38

[52] U.S. Cl. ..... 89/33.25

[58] Field of Search ..... 89/33.04, 33.1, 33.14, 89/33.16, 33.17, 33.2, 33.25

[56] References Cited

U.S. PATENT DOCUMENTS

| | | | |
|---|---|---|---|
| 863,101 | 8/1907 | Schwarzlose | 89/33.25 |
| 4,061,074 | 12/1977 | Johnson et al. | 89/33.25 |
| 4,311,082 | 1/1982 | Johnson et al. | 89/199 |

*Primary Examiner*—Charles T. Jordan
*Assistant Examiner*—Ted L. Parr
*Attorney, Agent, or Firm*—Anthony T. Lane; Robert P. Gibson; Edward F. Costigan

[57] ABSTRACT

In a weapon system including a gun barrel and a bolt carrier, a cartridge feeder system comprises sprockets for stripping cartridges individually from a cartridge belt, and moving the cartridges in an upward direction against guide ramps for positioning the cartridge on a pedestal support having a profile for holding the cartridge in vertical angular alignment between the chamber of the barrel and a bolt lug of the bolt of the bolt carrier, thereby permitting larger cartridges to be fed to the barrel in the space between the open bolt and the chamber, which space can accommodate only smaller caliber cartridges in the horizontal distance therebetween, whereby as the bolt moves the cartridge into the chamber, the angular positioning of the cartridge is changed via the profile of the pedestal support, permitting safe entry of the cartridge into the chamber.

28 Claims, 13 Drawing Figures

FIG. 3
PRIOR ART
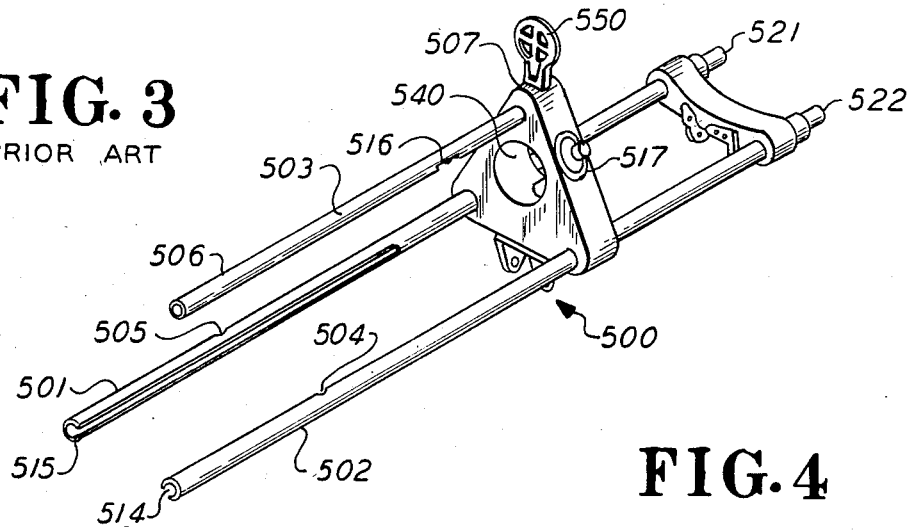
FIG. 4
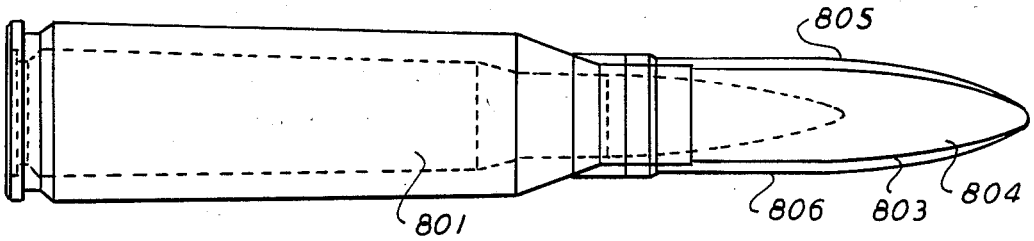
FIG. 6
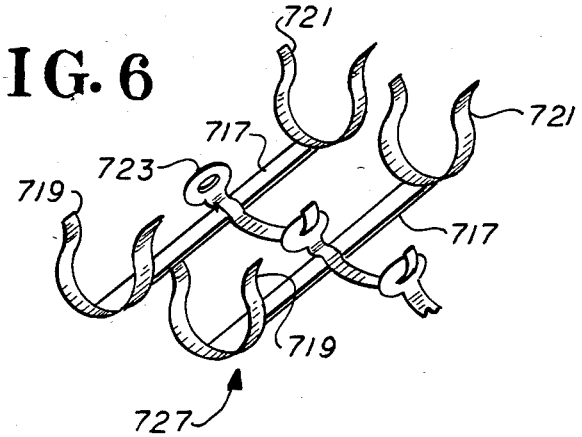
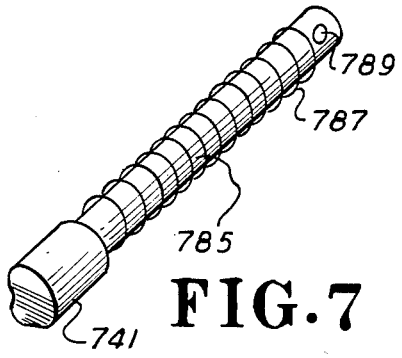
FIG. 7
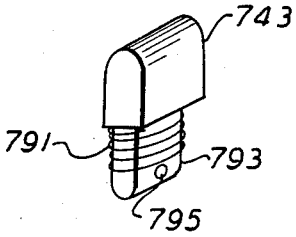
FIG. 8

WEAPON CARTRIDGE FEEDER APPARATUS AND METHOD

GOVERNMENT RIGHTS

The invention described herein may be manufactured, used and licensed by or for the Government for governmental purposes without the payment to me of any royalties thereon.

CROSS REFERENCE TO RELATED APPLICATIONS

This application is related to the weapon system disclosed in U.S. Pat. No. 4,311,082 issued Jan. 19, 1982.

FIELD OF THE INVENTION

The field of the present invention relates generally to weapon systems, and more particularly, to cartridge feeder apparatus for automatic weapon systems.

BACKGROUND OF THE INVENTION

In U.S. Pat. No. 4,311,082 for GENERAL PURPOSE AUTOMATIC WEAPON SYSTEM, issued Jan. 19, 1982, a gas operated, fully automatic weapon system with a dual feed mechanism is disclosed. In column 5, lines 28 through 35, the patent describes how the weapon can generally be adapted to receive different size ammunition. However, the machine gun taught therein is basically designed to fire 0.50 caliber ammunition, making the conversion to fire a 0.60 caliber and 20 mm caliber ammunition difficult and complicated, because of the larger size of the this ammunition relative to 0.50 caliber ammunition. In converting the weapon system to fire different calibers of ammunition, it is desirable that the basic weapon frame shown in FIG. 8 of the patent be utilized, and that as few parts as possible be necessarily replaced in converting the system. This constraint requires that the same feeder space be used for all ammunition calibers desired to be fired in the weapon. Accordingly, this presents a problem in feeding larger diameter and longer cartridges relative to the 0.50 caliber ammunition, in the same space allotted for the latter.

The present invention overcomes the problems in the prior art weapon systems, by providing for a cartridge feeder apparatus and method of feeding that permits 0.60 caliber and 20 mm cartridges to be placed in proper alignment for feeding into the chamber by the gun bolt as the latter moves forward. The present inventive mechanism includes means for positioning cartridges from a horizontal to an angular plane upon a pedestal means within the same space available for the 0.50 caliber ammunition, whereby when the gun bolt is moved forward it pushes the larger cartridges directly into the chamber of the barrel, the profile of the pedestal means providing a changing angular orientation of the cartridge as it is pushed forward.

DESCRIPTION OF THE DRAWINGS

In the drawings, like items are indicated by the same reference number, wherein:

FIG. 3 is a perspective view of the basic weapon frame;

FIG. 4 is an overlay drawing showing the relative size differences between 0.50 and 0.60 caliber ammunition, and 20 mm ammunition;

FIG. 6 is a perspective view of several cartridge holders linked together to form a cartridge belt;

FIG. 7 is a pictorial view of a plunger of the present invention;

FIG. 8 is a pictorial view of another plunger of the present invention.

DETAILED DESCRIPTION OF THE INVENTION

With reference to the drawings, as previously mentioned, the present invention is a cartridge feeder system and method for an automatic weapon system. Although the present invention is shown and described as adapted for use in the GENERAL PURPOSE AUTOMATIC WEAPON SYSTEM of U.S. Pat. No. 4,311,082, it is not meant to be so limited, and as described will have use in many other weapon systems as would be clear to one of ordinary skill in the art. For the sake of brevity, not all of the features of the prior automatic weapon system are described herein, but the drawings and teachings of U.S. Pat. No. 4,311,082, issued on Jan. 19, 1982, are incorporated herein by reference.

Figure 1:
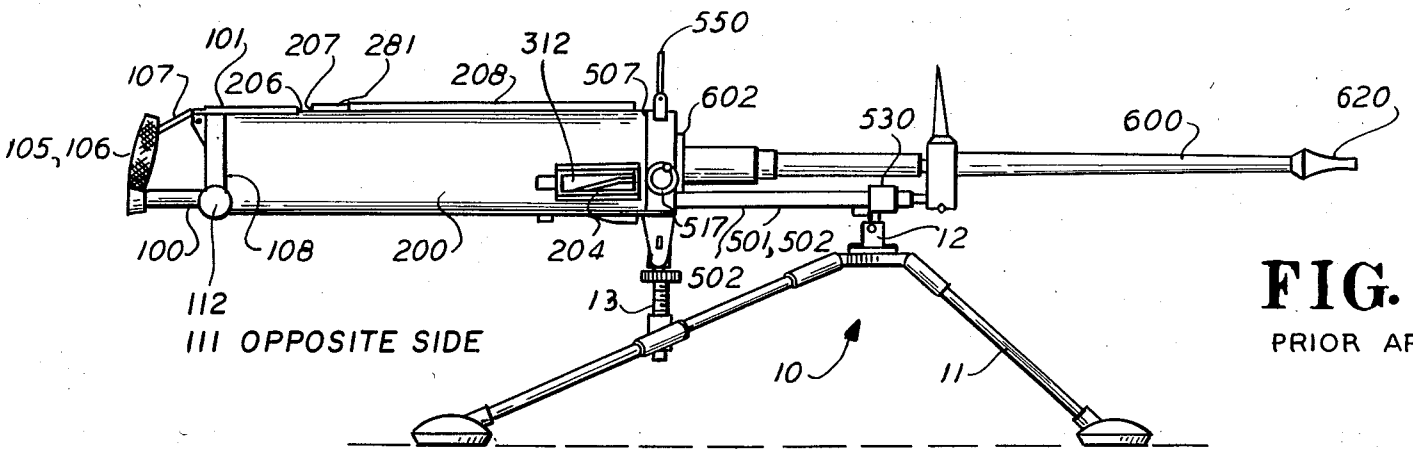
FIG. 1 PRIOR ART
FIG. 1 is a side view of the fully assembled weapon.

FIGS. 1 and 3 are identical to FIGS. 1 and 8 of the previously mentioned patent. Also for brevity, all reference numerals below 700 are identical to the reference numerals as used in the previously incorporated patent, and if a detailed explanation or reference to such reference numerals is not made herein, reference is made to the previous patent for a more detailed description thereof. Reference numerals in the drawing including and greater than 700 are for specifically describing details of the present invention.

In FIG. 1, the typical weapon system includes a dual feed machine gun 10, consisting of a tripod 11, a pintle 12, a tripod adjuster 13, a back plate unit 100, an automatic sear 101, dual grips 105 and 106, a back plate 108, a notch 206, a slot 207, a manual charge handle 281, a dust cover 200, a tubular member 208, a forward recesss 204, a receiver end cap 507, a rear sight 550, a pin for unlocking the barrel assembly 517, a barrel extension 602, a tube guide 530, a barrel 600, a flash suppressor 620, a right side incoming ammunition slot 312 (the left side incoming ammunition slot being a mirror image thereof) a left and right tube 501, 502, and disassembly knobs 111, 112.

With reference to FIG. 3, the basic frame of the weapon system includes a lower receiver tube 501, having a slot 515 and a recess 505; another lower receiver tube 502 having a recess 504 and a slot 514; an upper receiver tube 503 having a recess 506 and a notch 516; a hole 540 through the end cap 507 for receiving the barrel 600; and dual tappet gas systems 521 and 522; the aforementioned all comprising a receiver unit 500.

The illustrative weapon system is operated by initially inserting cartridge belts into the incoming ammunition slots 311 and 312. Thereafter, initial charging is accomplished by manually pulling back on the manual charge handle 281 to cock the system. Next, the weapon system operator grasps the dual grips 105 and 106 in each hand and presses with his thumb on the butterfly trigger 107, releasing a bolt for pushing a cartridge into the chamber of the barrel 600, and firing the cartridge. Thereafter, gases generated in firing the cartridge cause the weapon system to recoil, forcing the bolt (not shown) backward into a cocked position, whereafter the bolt moves forward by spring action to insert a new cartridge into the barrel 600, fire the cartridge and repeat the cycle in an iterative fashion until all of the cartridges have been fired, or until the firing is manually interrupted.

Cartridge size comparisons are shown in FIG. 4 for 0.50, 0.60 caliber, and 20 mm cartridges 801, 803 and 805, respectively. As shown, the 0.50 caliber cartridge 801 is shorter and narrower than either of the other two cartridges 803 or 805, respectively. However, the 0.60 caliber and 20 mm cartridges 803, 805, have the same length, and substantially the same width with the exception of their projectile portions 804 and 806, respectively.

With reference to FIGS. 2 and 5 through 13, the dual cartridge selective feed unit 700 of the present invention permits the illustrative weapon system to fire either the 0.60 caliber or 20 mm cartridges, as will be described in detail in the following paragraphs.

Figure 5:
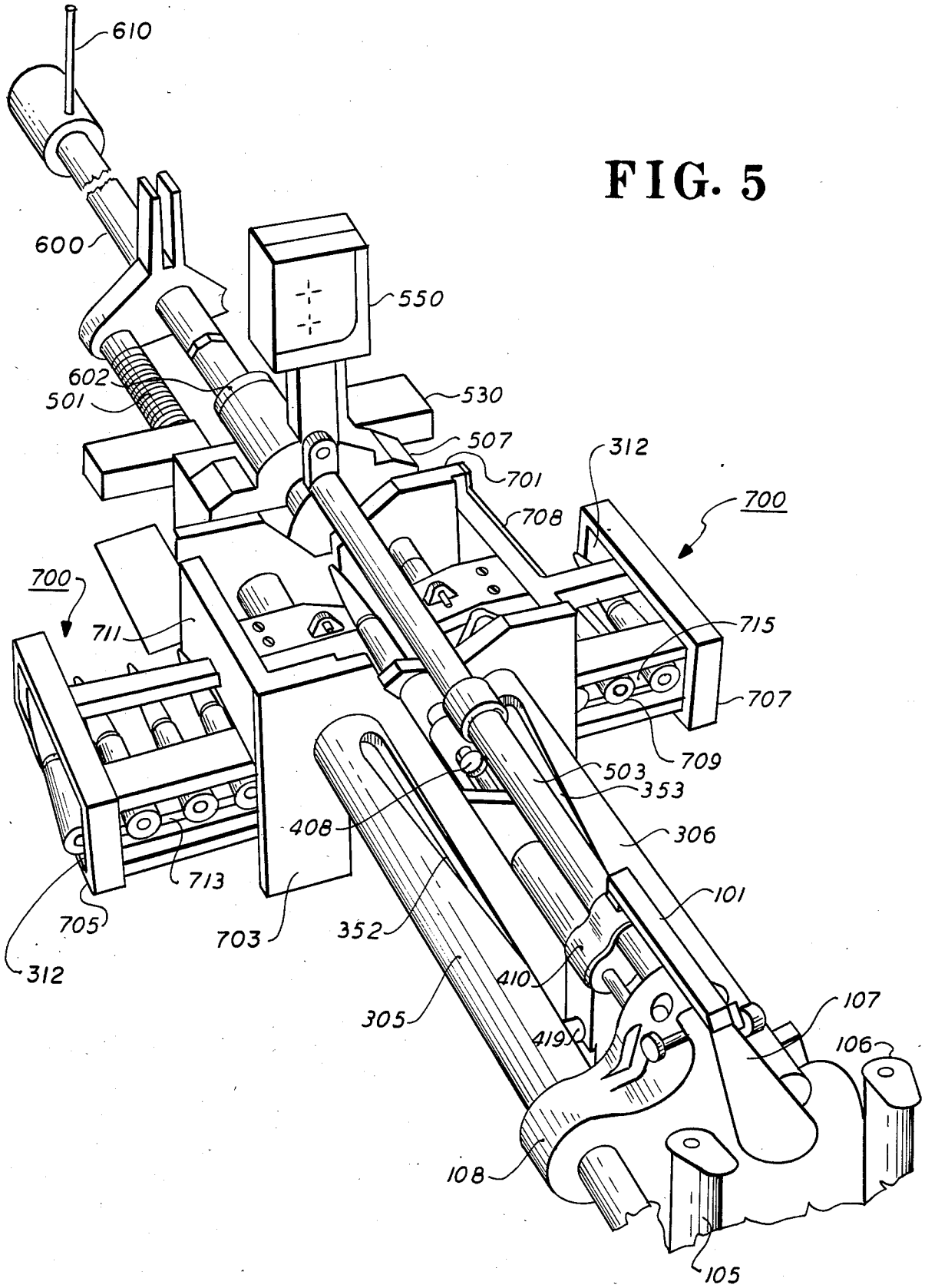
FIG. 5 is a perspective view looking from the top left at the feeder system of the present invention as adapted for use in the weapon system of U.S. Pat. No. 4,311,082.
Figure 11:
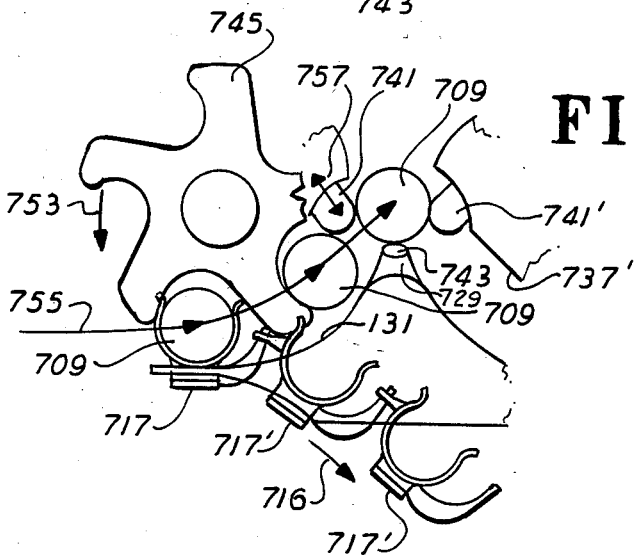
FIG. 11 is a partial rear view showing the rear portion of the feeder of the present invention in stripping a cartridge from a cartridge belt and delivering the same into proper position.

In FIG. 5 the dual cartridge selective feed unit 700 of the present invention is shown adapted for use in the illustrative weapon system of the prior patent U.S. Pat. No. 4,311,082. The portions of the illustrative or typical weapon system shown include the barrel 600, front sight 610, lower tube 501, barrel extension 602, rear sight 550, tube guide 530, receiver end cap 507, cam pin 408, upper tube 503, left side harmonic feed cam path 352, right side harmonic feed cam path 353, left feed cam assembly 305, right feed cam assembly 306, rear yoke of bolt carrier 410, automatic sear 101, roller 419, back plate 108, left and right grips 105 and 106, respectively, and butterfly trigger 107. Portions of the present invention shown include but are not limited to a front plate 701, an intermediate plate 703, a left cartridge feed assembly 705 having a left slot 713, a right cartridge feed assembly 707 having a right slot 715, a right wall 708, and a left wall 711. With further reference to FIG. 6 cartridges 709 are retained by cartridge holders 717, each holder 717 having a front clip 721, a rear clip 719, a tie strap 723 for coupling to an adjacent cartridge holder via a receiver slot 725. A number of cartridge holders 717 are shown linked together to form a belt. Accordingly, as shown in FIG. 6, a cartridge belt of any practical length can be formed by coupling together the cartridge holders 717. As shown in FIG. 11, spent cartridge clips 717 are ejected from the weapon system through an opening 716 in the bottom of the cartridge feed assembly 700.

Figure 9:
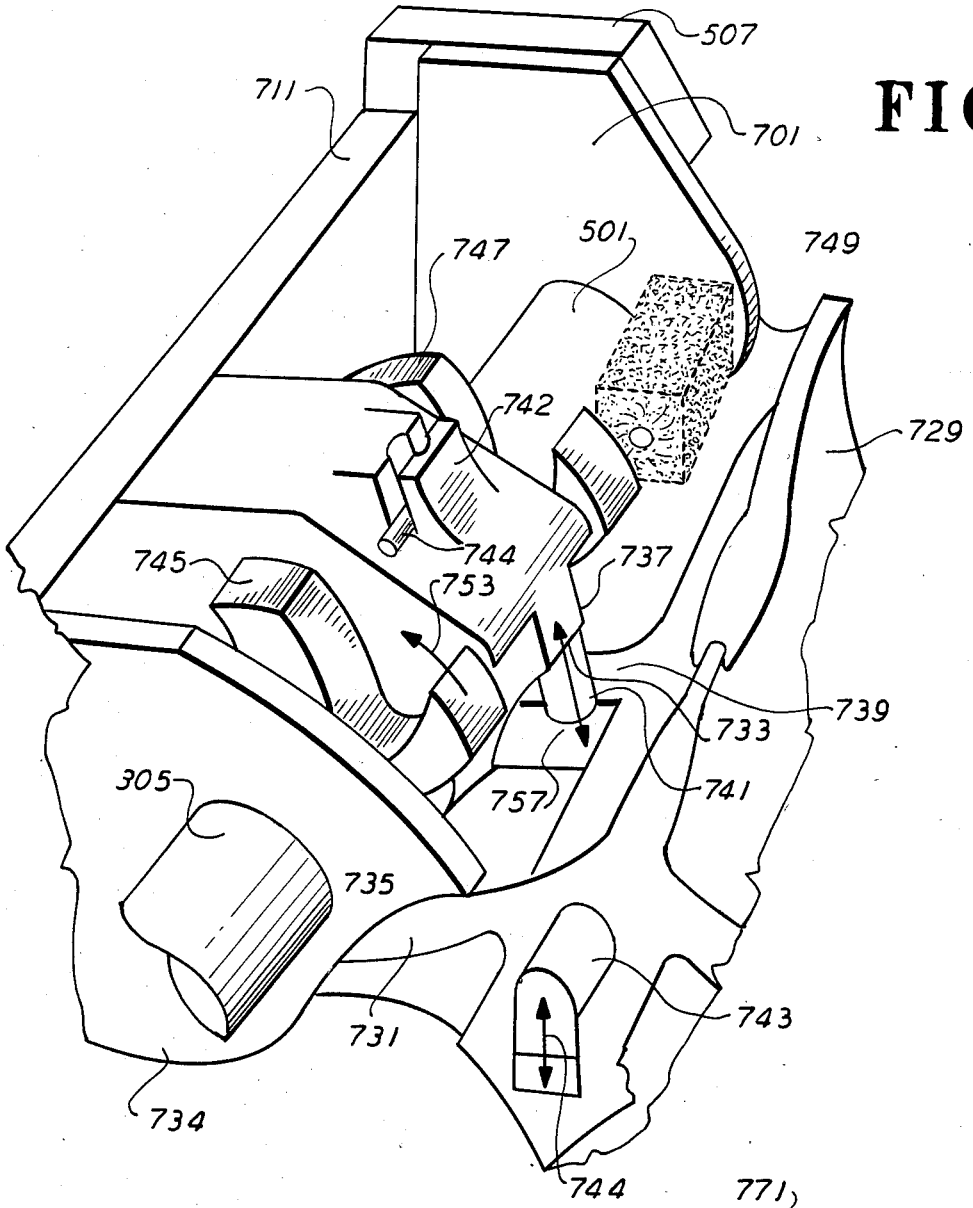
FIG. 9 is a perspective view of a portion of the left-hand side components of the present inventive feeder.
Figure 13:
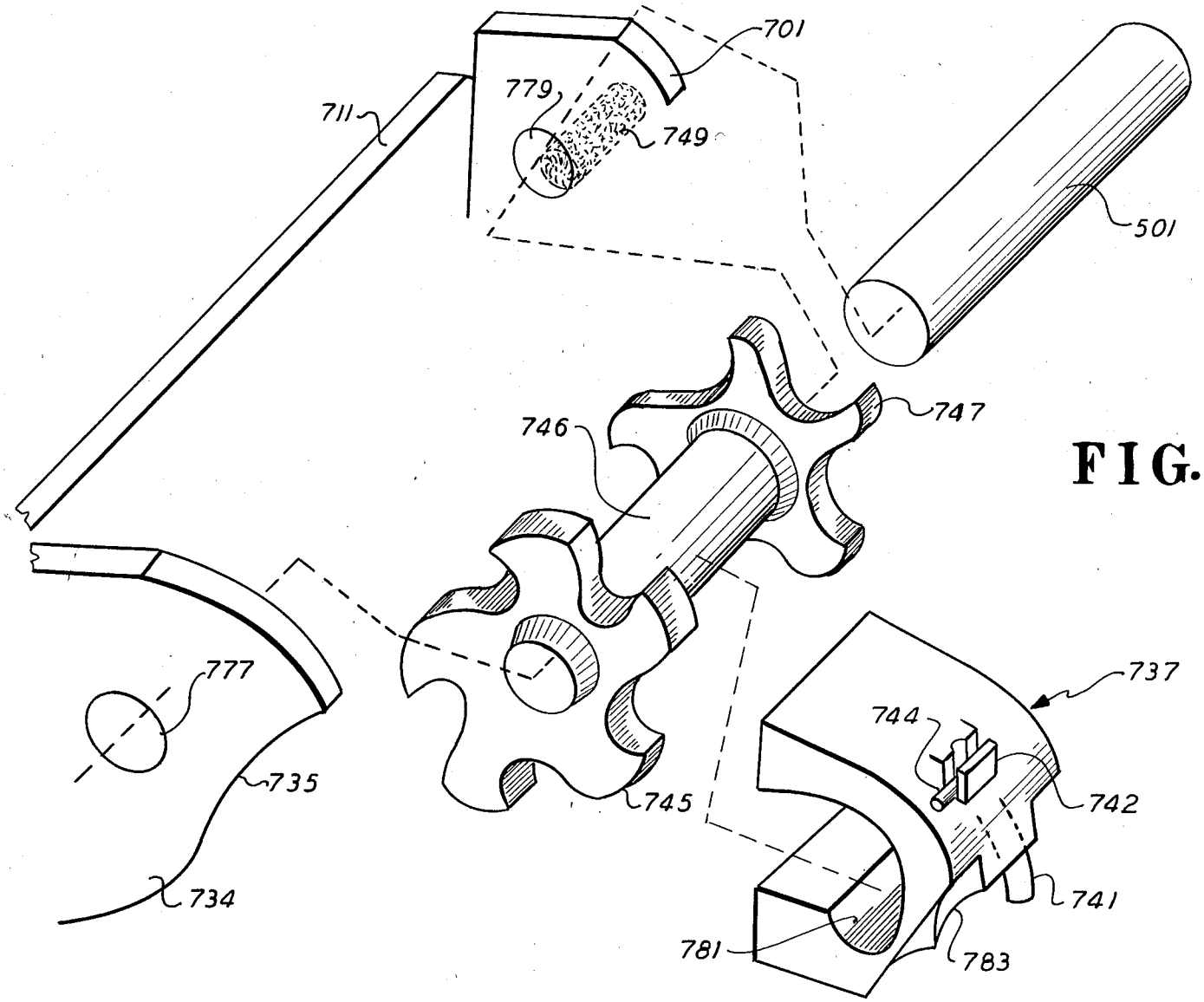
FIG. 13 is an exploded pictorial assembly view of a portion of the left-hand side components of the present invention for feeding cartridges from the left.

In FIG. 9, a pictorial view of a portion of the left-hand side components of the dual selective feed unit 700 of the present invention include a left support tube and axle 501 of the weapon system, a guide brush 749, a pedestal support 729, a forward most sprocket 747, a center ramp member 737, and a rear most sprocket 745, the sprockets rotating in the direction of the arrow 753, via movement of the feed cam tube 305 rigidly connected to axle 746 shown in FIG. 13. Further included is a cartridge base ramp plate 734, a lower cartridge base ramp 731, an upper cartridge base ramp 735, a center cartridge lower ramp 739, a center cartridge upper ramp 733, a spring biased plunger 741, captively held in the center ramp member 737 via a support 742 and pin 744 (as will be further described), and a plunger 743 mounted within a slot-like hole of the pedestal support 729 for movement in the up and down directions denoted by the arrow 744.

Figure 10:
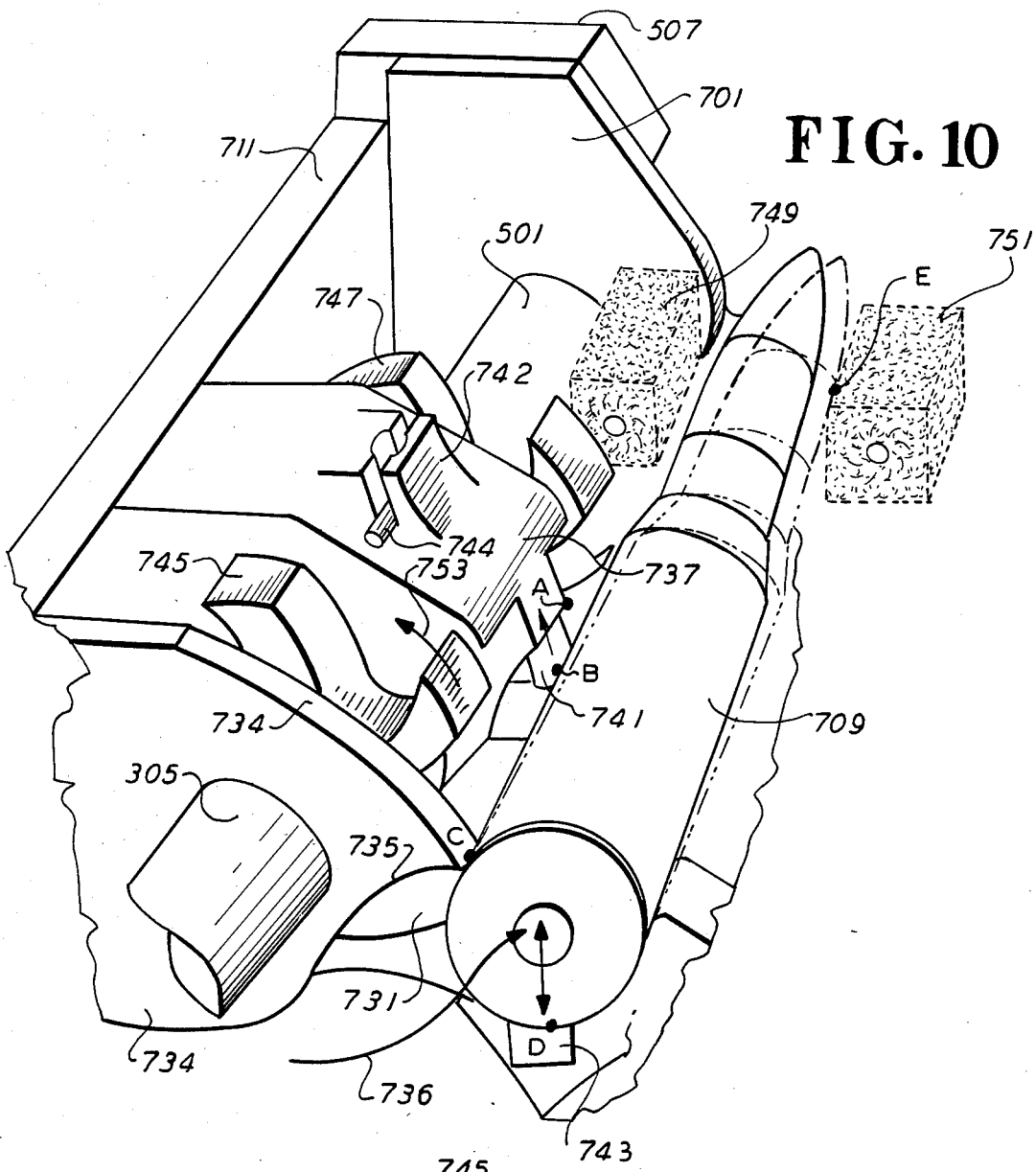
FIG. 10 is a perspective view of a portion of the left-hand side of the present invention in feeding a cartridge into position.

As shown in FIG. 10, as the sprockets 745 and 747 rotate in the direction indicated by arrow 753, a cartridge 709 is stripped from a cartridge clip 717 (not shown) when captured by the sprockets 745, 747, and guided in upward rotation via the ramp surface 735 of the base ramp plate 734 and the lower cartridge base ramp 731 (see FIG. 9), as the sprockets 745, 747 move the cartridge upward toward the top of the pedestal support 729. As the cartridge 709 is being moved upward, its center portion eventually contacts plunger 741 and initially pushes the plunger inward into a hole (not shown) in the center ramp member 737. With reference to FIG. 11, as the sprockets 745 and 747 continue to rotate the cartridge 709 toward the top of the pedestal as shown by the direction of feed 755, as the cartridge nears the top of the pedestal support 729, the plunger 741 begins to push outward forcing the cartridge onto the top of the pedestal support 729, whereupon the other side of the base of the cartridge 709 will strike the right side plunger 741', and the forward portion of the cartridge 709 at the projectile end will strike the guide brush 751, the cartridge 709 now being in position for being driven into the chamber 763 of the barrel 602 (see FIG. 2). Note in FIG. 11 that stripped cartridge links 717 move downward in the direction of the arrow 716, as shown. In so positioning cartridge 709 on top of the pedestal support 729, some of the cartridge control points for such positioning as the cartridge 709 is rotated upward by sprockets 745 and 747 include points A, B, C, D and E (FIG. 10).

Figure 2:
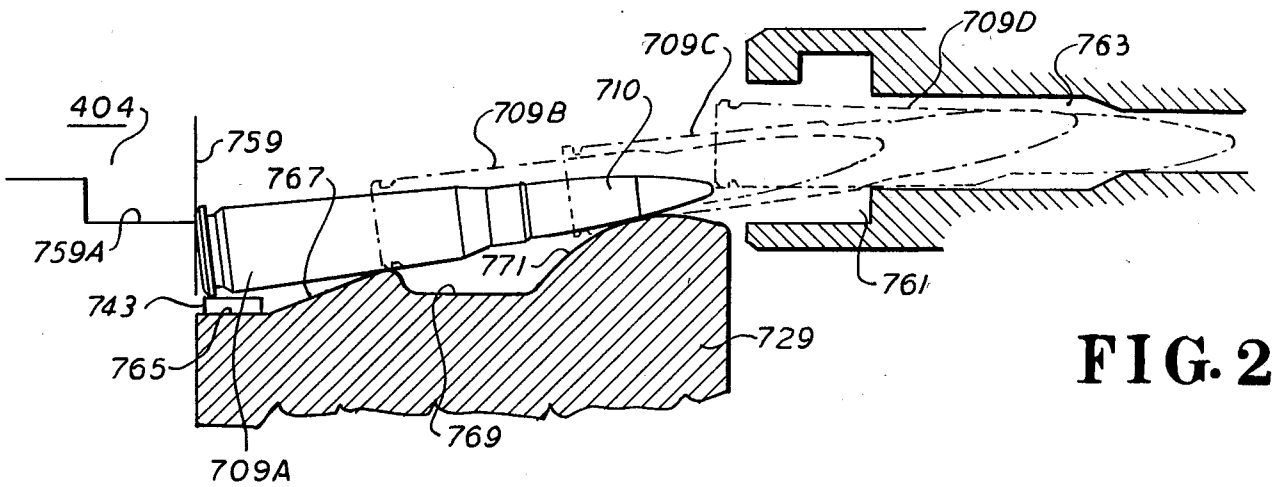
FIG. 2 is a partial perspective and partial cutaway view of a cartridge aligned on a pedestal support of the present invention, showing the various angles the cartridge goes through as it is pushed into the chamber of the gun barrel by the gun bolt.

In FIG. 2, a cartridge 709A is shown in position upon the pedestal support 729, awaiting insertion into the chamber 763 of barrel extension 602. The lines 759 and 759A represent the bolt lug face and the bottom, respectively, of bolt 404 of the illustrative weapon system. Due to the timing between the recoiling bolt and the rotating sprocket, as the bolt recoils and moves rearward, the bottom 759A of the bolt lug can contact the cartridge 709A at its base. A spring loaded plunger 743, which is located in support 729 to support the base of the cartridge in the feed position, allows the cartridge to be pushed downward by the recoiling bolt. Thereafter, as the bolt moves further rearward clear of the plunger, it allows the plunger to return to the feed position by spring action, so that when the bolt lug face 759 moves forward and engages the base of the cartridge, the plunger provides the proper angular orientation of the cartridge as it begins moving toward the chamber 763. As shown in phantom, continued forward movement of the bolt lug face 759 causes the cartridge to eventually assume the position shown by the phantom cartridge 709B, and progressively to the position shown by the phantom cartridge 709C. At each successive position of the cartridge as it is moved forward into the chamber 763, and initially into the breech 761 of barrel 602, the angular orientation of the cartridge relative to the chamber 763 is changed via the profile of support 729 represented by the various contoured surfaces 767, 769, and 771, as shown. Eventually, the cartridge will assume the position shown phantom by 709D and be horizontal in the chamber 763, whereupon insertion of the cartridge 709 is thereafter completed. Note that via the use of the plunger 743, and the contour of the surfaces 767, 769, and 771, respectively, of pedestal 729, the tip of the projectile 710 of the cartridge 709 is prevented from touching the interior walls of the barrel chamber 763, as the cartridge 709 is moved forward, thereby insuring safe operation of the weapon system.

Figure 12:
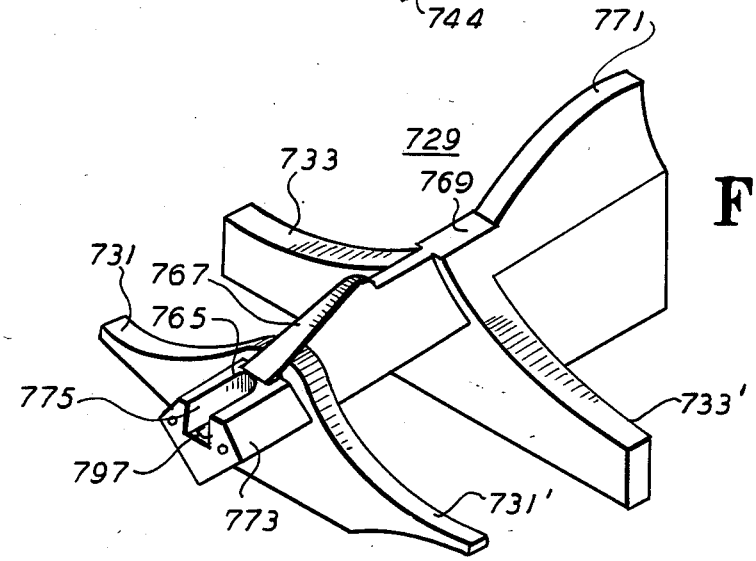
FIG. 12 is a pictorial view of the pedestal support of FIG. 2.

An isometric or pictorial view of the pedestal support 729 is shown in FIG. 12. Note that the ramp 731 for guiding the lower portion of the base of a cartridge 709, and the ramp 733 for guiding the lower portion of a center region of the cartridge 709, formed the left-side of the support 729, and have corresponding right-side ramp components 731' and 733' for right-side feeding of cartridges onto the pedestal support 729. Although only the left-side feed components of the present invention have primarily been shown, it should be understood that the right-side feed components are identical and in mirror image to the left-side components, with the right-side feed components rotating in the opposite direction for feeding cartridges onto the top of the pedestal support 729. The pedestal support 729 includes a recess 775 in a rearmost portion 773 for housing the plunger 743.

In FIG. 13, an exploded pictorial assembly view of a portion of the left-hand side components of the present invention is shown. The sprockets 745 and 747 are joined by a hollow tubular axle 746. The center ramp member 737 includes a hollowed out area 781 contoured for permitting this member to be mounted over the axle 746 while still permitting rotation of the axle 746. The support tube 501 is inserted through the hole 779 of the front plate 701 and through the axle 746 and out the hole 777 of the cartridge base ramp plate 734.

As shown in FIG. 7, the plunger 741 is connected to a rod 785 upon which a spring 787 is mounted. The rod includes a hole 789 for receiving the pin 744 shown in FIGS. 9, 10 and 13 for captively holding the plunger within a hole of the center ramp body 737. The slot-like support member 742 permits the captive plunger 741 to be pushed into the body of the center ramp 737, and to similarly descend from the body via the action of the compressed spring 787 forcing plunger 741 outward after a compression of the former.

In FIG. 8, the plunger 743 is connected to a rectangular-like rod 793 upon which a spring 791 is mounted. The rectangular rod 793 includes a hole 795 for receiving a pin (not shown) for retaining the plunger 743 in the slotway 775 of support member 729. The rod 793 is inserted through a hole 797 in the lower portion of the slotway 775 (see FIG. 12), and pinned in a manner permitting the plunger 743 to move up and down in the slotway 775 with the spring 791 urging the plunger to protrude from the slotway 775 in its rest position.

OPERATION OF THE PREFERRED EMBODIMENT

Operation of the present invention in the typical weapon system illustrated will now be described with reference to the drawings. Assume that the weapon system as previously described, has been cocked and placed into an automatic mode of operation whereby the weapon is rapidly firing in sequence. As the rear yoke 410 of the bolt carrier is moved rearward via gas pressure generated by the firing of a cartridge, and forward via spring compression of springs carried within tubes 501 and 502 in alternative fashion during automatic firing, the roller 419 is moved back and forth within the feed cam path 352 of the left feed cam 305, for example, when feeding cartridges from the left, causing rotation of the sprockets 745 and 747 in proper timing for stripping cartridges 709 from the links 717. Successive cartridges 709 are delivered to the top of the pedestal support 729 in proper time sequence via movement of the sprockets 745, 747, as previously described. As each cartridge 709 is moved upward, the lower portions of a cartridge 709 are guided by the ramps 731 and 733 of support 729, and the upper portions of the cartridge 709 are guided by the ramps 735, 739, and the plunger pin 741, and guides 749 and 751. Upon a cartridge 709 being positioned on the top of the pedestal support profile 729, positioning of a cartridge 709 thereon is maintained by the guide brushes 749, 751, and plungers 741 and 741'. The cartridge 709 is then driven into the chamber 763 via a forward movement of the bolt lug face 759 as previously described.

The present inventive apparatus and method for feeding cartridges in a weapon system is adaptable for use in weapon systems other than the automatic weapon system described herein. Also, the present invention may be used in manual weapon systems, in certain applications.

What is claimed is:

1. In a weapons system including a gun barrel having a breech provided with a chamber for receiving cartridges and a bolt carrier means for pushing a cartridge into said chamber, the improvement comprising:

cartridge feeder means positioned between said bolt carrier means and said chamber for feeding said cartridges into said chamber from an initial horizontal to an angular position, said feeder means provided with a pedestal having a top surface for supporting cartridges positioned between said bolt and said chamber, said pedestal having a profile along the top surface thereof provided with a first to a fourth consecutive surface wherein said first section is rearwardmost relative to said second through fourth sections, said first section being substantially flat or horizontal, said second section being ramp-like and positively sloped toward said chamber, said second section terminating in a downward directed step to said third section, the latter being substantially flat and centrally located, said fourth section having an upwardly tapering convex-like top profile which terminates near the lower edge of the chamber of said barrel, whereby said feeder means for feeding within a space, allocated for cartridges of one caliber, cartridges having calibers relatively larger than said one caliber, said feeder means directly positioning said larger caliber cartridge from a horizontal to an angular position between said bolt carrier and said chamber during each rearward movement of said bolt carrier means.

said feeder means automatically changing the angle of said cartridge relative said chamber as said bolt carrier means operates with forward movement to push said cartridge into said chamber ensuring safe entry of said larger caliber cartridge into said chamber preventing the tip of said cartridge from contacting wall portions of said chamber.

2. The weapons system of claim 1 wherein said cartridge feeder means is provided with:

a cartridge carrying means forming a belt-like cartridge carrier for supplying in a succession a plurality of cartridges to said weapon system, a stripping means juxtaposed one side of said pedestal for removing individual cartridges from said carrying means during each rearward movement of said bolt carrier means, said stripping means provided with a sprocket responsive to rearward movement of said bolt carrier means, said sprocket engaging a cartridge in said carrying means and lifting said cartridge upwardly to said pedestal, a guidance means for positioning said stripped cartridge upon the top of said pedestal prior to initiation of forward movement of said bolt carrier means toward said chamber, said guidance means provided with a first and second ramp for guiding said cartridge upward from said sprocket means towards said pedestal, said guidance means provided with a first and second spring biased plunger, said first plunger contacting the central portion of said cartridge and pushing said cartridge on top of said pedestal as said cartridge moves toward its extreme upper position, thereafter said first and second plungers contacting central portions on both sides of said cartridge for centering the center portion of said cartridge upon said pedestal.

3. The weapon system of claim 2, wherein said guidance means further includes brush-like stud means located forward of said sprocket means and projecting from the inside face of an end cap, and positioned for contacting and maintaining the horizontal alignment of the projectile portion of said cartridge to said chamber as said bolt carrier is operated for pushing said cartridge into the chamber of said barrel.

4. The weapon system of claim 3, wherein said guidance means further includes second spring biased plunger means captively but slideably mounted within a hole in the top of a rearwardmost portion of said pedestal means for both supporting the base of said cartridge in a feed position upon said pedestal means, while permitting said cartridge to be pushed downward by the rearward movement of said bolt carrier means via said second plunger receding into said hole in said pedestal means, and thereafter returning said cartridge to the feed position as said bolt carrier means moves further rearward, via said second plunger moving out of said hole.

5. The weapon system of claims 2, or 3, or 4, wherein said first ramp means includes:

a first concave ramp located perpendicular to and tapering downward from a rearward portion of the top of said pedestal means, for guiding a rearward lower portion of said cartridge in its upward movement toward the top of said pedestal means; and a second concave ramp located both forward of said first ramp relative to said barrel, and perpendicular to and tapering downward from a substantially central portion of the top of said pedestal means.

6. The weapon system of claim 5, wherein said second ramp means includes third and fourth ramps located rearward of said first ramp relative to said barrel, and intermediate said first and second ramps, respectively, each of said third and fourth ramps having upwardly tapering concave-like profiles for guiding rearwardmost and substantially central upper portions, respectively, of said cartridge as it moves upward toward the top of said pedestal means.

7. The weapon system of claim 6, wherein said first spring biased plunger means includes a plunger rod captively mounted in and partially extending from a hole in an upper portion of the face of said fourth ramp, and being spring biased for partially retracting into said hole when first contacted by said central portion of said cartridge as the latter moves upward, and for thereafter extending outward from this hole for pushing said cartridge onto the top of said pedestal means as said cartridge attains the height thereof.

8. The weapon system of claim 6, wherein said second spring biased plunger means includes a plunger rod captively but slideably mounted within and partially extending from a hole in the rearwardmost portion of the top of said pedestal means.

9. The weapon system of claim 6, wherein said sprocket means includes:

a first sprocket wheel between said third and fourth ramps; and a second sprocket wheel located on the opposite side of said fourth ramp relative to said first sprocket.

10. The weapon system of claim 3, wherein said brush-like stud means includes first and second brush guides each having brush hairs about their longitudinal axes, and each being juxtaposed to either side of said pedestal means, respectively.

11. The weapon system of claim 10, further including another means for feeding cartridges from the other side of said pedestal means to the top thereof, said another means being located along the other side of said pedestal means including:

another first and second ramp means;

another first and second spring biased plunger means; and another sprocket means.

12. The weapon system of claim 11, wherein said plunger rod of said another first spring biased plunger means coacts with the plunger rod of the other first spring biased plunger means for maintaining alignment of the central portion of said cartridge upon the top of said pedestal means by contacting opposite sides of said cartridge, respectively, regardless of the direction from which said cartridges are fed relative to said pedestal means.

13. An automatic weapon system comprising:

a gun barrel having a breech or chamber for receiving a cartridge;

receiver means for providing the primary support frame for said weapon, said receiver means including at least first through third elongated tubular members mounted in substantially parallel relationship and a triangular pattern between inside faces of a forwardmost end cap and a rearwardmost back plate, said end cap including means for mounting said gun barrel near its breech end between said first through third tubes, said gun barrel extending from an outside face of said end cap, said first tubular member being uppermost relative to said second and third tubular members, the latter two being coplanar at substantially the same height;

elongated force-transmitting means including operating rods longitudinally movable within each of said second and third tubular members;

gas cylinder means connected between said gun barrel and said force transmitting means in each of said second and third tubular members, for applying forces generated by gases developed within said gun barrel during firing of said weapon to said force-transmitting means:

bolt carrier means slideably mounted upon said first tubular member for moving a cartridge into the breech of said barrel for firing said cartridge, said force- transmitting means being responsive to the gases generated by said firing for applying a recoil force to said bolt carrier means for moving the latter rearward; and cartridge feeder means for feeding within a space allocated for cartridges of one caliber, cartridges having calibers relatively larger than said one caliber, said feeder means being mounted upon said second and third tubes, and being responsive to recoil movement of said bolt carrier means for directly positioning said larger caliber cartridges from a horizontal to an angular position between a bolt lug face of said bolt carrier means and the breech or chamber of said gun barrel, said cartridge feeder means being further operative with said bolt carrier means, whereby after the recoil cycle the latter moves forward for pushing said cartridge into said chamber of said barrel preparatory to firing said cartridge.

14. The automatic weapon system of claim 13, wherein said cartridge feeder means includes pedestal means for supporting said larger cartridge at a desired angle between a bolt of said bolt carrier means and the breech of said gun barrel.

15. The automatic weapon system of claim 14, further including said pedestal means having a profile for changing the angle of said cartridge relative to said barrel chamber as said bolt carrier means pushes said cartridge into the chamber of said barrel, for substantially preventing the tip of a projectile of said cartridge from contacting the chamber of said barrel as said cartridge is pushed into said chamber.

16. The automatic weapon system of claim 15, wherein the profile of said pedestal means is substantially flat or horizontal in a rearwardmost portion, followed by a positively sloped ramp-like portion which terminates via a downward step to a substantially flat or horizontal central portion, followed by a forwardmost upwardly tapering convex-like portion, the end of which terminates near the lower edge of the breech of said barrel.

17. The automatic weapon system of claim 14, wherein said cartridge feeder means further includes:

a plurality of link means arranged on a belt for carrying said cartridges;

delinking means for successively stripping individual cartridges from said links; and guidance means operative with said delinking means for positioning a delinked cartridge upon the top of said pedestal means during each recoil cycle of said weapon system.

18. The automatic weapon system of claim 17, wherein said delinking means includes sprocket means rotatively responsive to recoil movement of said bolt carrier means for captively engaging successive ones of said cartridges, and rotatively moving the captive cartridge out of its link means and upward toward the top of said pedestal means from one side thereof.

19. The automatic weapon system of claim 18, wherein said guidance means includes:

first ramp means for guiding lower side portions of said cartridge toward the top of said pedestal means as said sprocket means moves said cartridge upward proximate said one side of said pedestal means;

second ramp means for guiding upper side portions of said cartridge as it moves upward proximate said one side of said pedestal means;

first and second spring biased plungers means, said first plunger means contacting a central portion on said cartridge and pushing it onto the top of and from said one side of said pedestal means as said cartridge moves toward its extreme uppermost position, and for thereafter said first and second plunger means contacting central portions on both sides of said cartridge for substantially centering the central portion of said cartridge upon said pedestal means; and brush-like stud means located forward of said sprocket means upon the inside face of said end cap, for contacting and maintaining the alignment of the projectile portion of said cartridge and the horizontal angular relation of said cartridge as said bolt carrier means operates to push said cartridge into said breech of said gun barrel.

20. The automatic weapon system of claim 19, wherein said guidance means further includes second spring biased plunger means located in a rearwardmost and lowest portion of the top said pedestal means for both supporting the base of said cartridge in a feed position upon said pedestal means, while permitting said cartridge to be pushed downward by the rearward movement of said bolt carrier means, and thereafter returning said cartridge to the feed position as said bolt carrier means moves forward for pushing said cartridge into said chamber of said barrel.

21. The automatic weapon system of claim 20, wherein said second spring biased plunger means includes a plunger rod captively but slideably mounted within and partially extending from a hole in the rearwardmost portion of the top of said pedestal means.

22. The automatic weapon system of claims 19, or 20, wherein said first ramp means includes:

a first concave ramp located perpendicular to and tapering downward from a rearward portion of the top of said pedestal means, for guiding a rearward lower portion of said cartridge in its upward movement to the top of said pedestal means; and a second concave ramp located forward of said first ramp, and perpendicular to and tapering downward from a substantially central portion of the top of said pedestal means.

23. The automatic weapon system of claim 22, wherein said second ramp means includes:

a third ramp located rearward of said first ramp relative to said barrel, said third ramp being perpendicular to said pedestal means and having an upwardly tapering concave-like profile for guiding a rearwardmost upper portion of said cartridge as the latter moves upward; and a fourth ramp located intermediate said first and second ramps, and having an upwardly tapering concave-like profile for guiding a substantially central upper portion of said cartridge as it moves upward toward the top of said pedestal means.

24. The automatic weapon system of claim 23, wherein said first spring biased plunger means includes a plunger rod captively mounted in a hole in and partially extending from an upper portion of the face of said fourth ramp, and being spring biased to partially retract into said hole when first contacted by said central position of said cartridge as the latter moves upward, and thereafter to move out of said hole to an extended position for pushing said cartridge onto said pedestal means as said cartridge attains the height of said pedestal means.

25. The automatic weapon system of claim 23, wherein said sprocket means includes:

a first sprocket wheel located between said third and fourth ramps; and a second sprocket wheel located on the opposite side of said fourth ramp relative to said first sprocket.

26. The automatic weapon system of claim 25, wherein said brush-like stud means includes two brush guides, said brush guides having brush hairs about its longitudinal axis, and being juxtaposed to either side of said pedestal means, respectively.

27. The automatic weapon system of claim 26, further including another means for feeding cartridges from the other side of said pedestal means to the top thereof, said another means being located along the other side of said pedestal means including:

another first and second ramp means;

another first and second spring biased plunger means; and another sprocket means.

28. The automatic weapon system of claim 27, wherein the plunger rod of said another first spring biased plunger means coacts with the plunge rod of the other first spring biased plunger means for maintaining alignment of the central portion of said cartridge upon the top of said pedestal means regardless of the direction of the side of said pedestal means said cartridges are fed from.

* * * * *